US008932190B2

(12) United States Patent
Moore

(10) Patent No.: US 8,932,190 B2
(45) Date of Patent: Jan. 13, 2015

(54) RESISTANCE BAND-BASED LEG STRENGTHENING AND TRAINING EXERCISE EQUIPMENT

(76) Inventor: Derrick Moore, Plano, TX (US)

( * ) Notice: Subject to any disclaimer, the term of this patent is extended or adjusted under 35 U.S.C. 154(b) by 0 days.

(21) Appl. No.: 13/488,390

(22) Filed: Jun. 4, 2012

(65) Prior Publication Data

US 2013/0324377 A1 Dec. 5, 2013

(51) Int. Cl.
*A63B 21/02* (2006.01)

(52) U.S. Cl.
CPC ..... *A63B 21/02* (2013.01)
USPC ..... 482/124

(58) Field of Classification Search
CPC ..... A63B 21/055; A63B 21/0552; A63B 21/0555; A63B 21/0557; A63B 21/1449; A63B 21/1423
USPC ..... 482/92, 139, 121, 122, 124
See application file for complete search history.

(56) References Cited

U.S. PATENT DOCUMENTS

| | | | | | |
|---|---|---|---|---|---|
| 4,815,731 | A * | 3/1989 | Suarez et al. | 482/124 |
| 4,862,563 | A * | 9/1989 | Flynn | 24/442 |
| D311,232 | S * | 10/1990 | Drennan et al. | D21/692 |
| 5,282,777 | A * | 2/1994 | Myers | 482/122 |
| 5,357,637 | A * | 10/1994 | Moore | 2/227 |
| D353,172 | S * | 12/1994 | Gaut | D21/692 |
| 5,490,826 | A * | 2/1996 | Rose | 482/74 |
| 5,573,487 | A * | 11/1996 | Wallner | 482/124 |
| 5,711,747 | A * | 1/1998 | Steinback | 482/124 |
| 6,049,953 | A * | 4/2000 | McCay et al. | 24/302 |
| 6,322,482 | B1 * | 11/2001 | Kim | 482/124 |
| 6,604,245 | B1 * | 8/2003 | Kinnier | 2/227 |
| 6,651,258 | B2 * | 11/2003 | Pelensky | 2/323 |
| D711,986 | S * | 8/2014 | Russotti | D21/694 |
| 2006/0000478 | A1 * | 1/2006 | Taylor | 128/869 |
| 2008/0132392 | A1 * | 6/2008 | Moulton | 482/122 |
| 2009/0118107 | A1 * | 5/2009 | Prstojevich et al. | 482/124 |
| 2010/0022390 | A1 * | 1/2010 | Cosgrove | 504/118 |
| 2010/0022930 | A1 * | 1/2010 | Koby et al. | 602/21 |
| 2013/0053750 | A1 * | 2/2013 | Taylor | 602/75 |

* cited by examiner

*Primary Examiner* — Oren Ginsberg
*Assistant Examiner* — Gary D Urbiel Goldner
(74) *Attorney, Agent, or Firm* — Thrasher Associates

(57) ABSTRACT

The invention provides an apparatus, system, and method for enhancing exercise effectiveness via first and second elastic resistance bands that wrap around a user's thighs.

10 Claims, 4 Drawing Sheets

RESISTANCE BAND-BASED LEG STRENGTHENING AND TRAINING EXERCISE EQUIPMENT

TECHNICAL FIELD OF THE INVENTION

The present invention relates to exercise equipment, and more particularly to weight-free resistance training.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

For decades, many have sought systems and methods for toning muscle without having to lift weights. For example, rubber resistance bands have become popular exercise accessories (as well as rehabilitation devices). However, resistance bands concentrate force on one specific point (usually at a loop or a hook), and, when they "go slack" the lose bands become distracting, annoying, and even dangerous since one may trip on a band. Other resistance devices are inconvenient in that they must be worn and washed as clothing, either forcing a user to purchase several items or wash them every day (and by doing so, reduce their effective life). The present invention provides a system and apparatus that overcomes these disadvantages.

BRIEF DESCRIPTION OF THE DRAWINGS AND TABLE

Various aspects of the invention, as well as an embodiment, are better understood by reference to the following detailed description. To better understand the invention, the detailed description should be read in conjunction with the drawings and tables, in which:

FIG. 1 illustrates a first side of inventive wraps.

FIG. 2 illustrates a second side of inventive wraps.

FIG. 3 shows the inventive thigh wraps being worn by a user.

FIG. 4 shows the inventive resistance wrap secured to thigh wraps.

Table 1 discloses particulars, such as preferred material combinations, used to make various wrap embodiments.

DETAILED DESCRIPTION OF THE INVENTION

Interpretation Considerations

When reading this section (which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "attaching" may be done by hook-and-loop attachment (such as Velcro®), snaps, hooks, belts, etc., and so a use of the word attaching invokes all methods of attachment known in and anticipated by the art, and all other modes of that word and similar words).

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for —functioning—" or "step for —functioning—" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

It should be noted in the following discussion that acts with like names are performed in like manners, unless otherwise stated. Of course, the foregoing discussions and definitions are provided for clarification purposes and are not limiting. Words and phrases are to be given their ordinary plain meaning unless indicated otherwise. The numerous innovative teachings of present application are described with particular reference to presently preferred embodiments.

Figure 1:
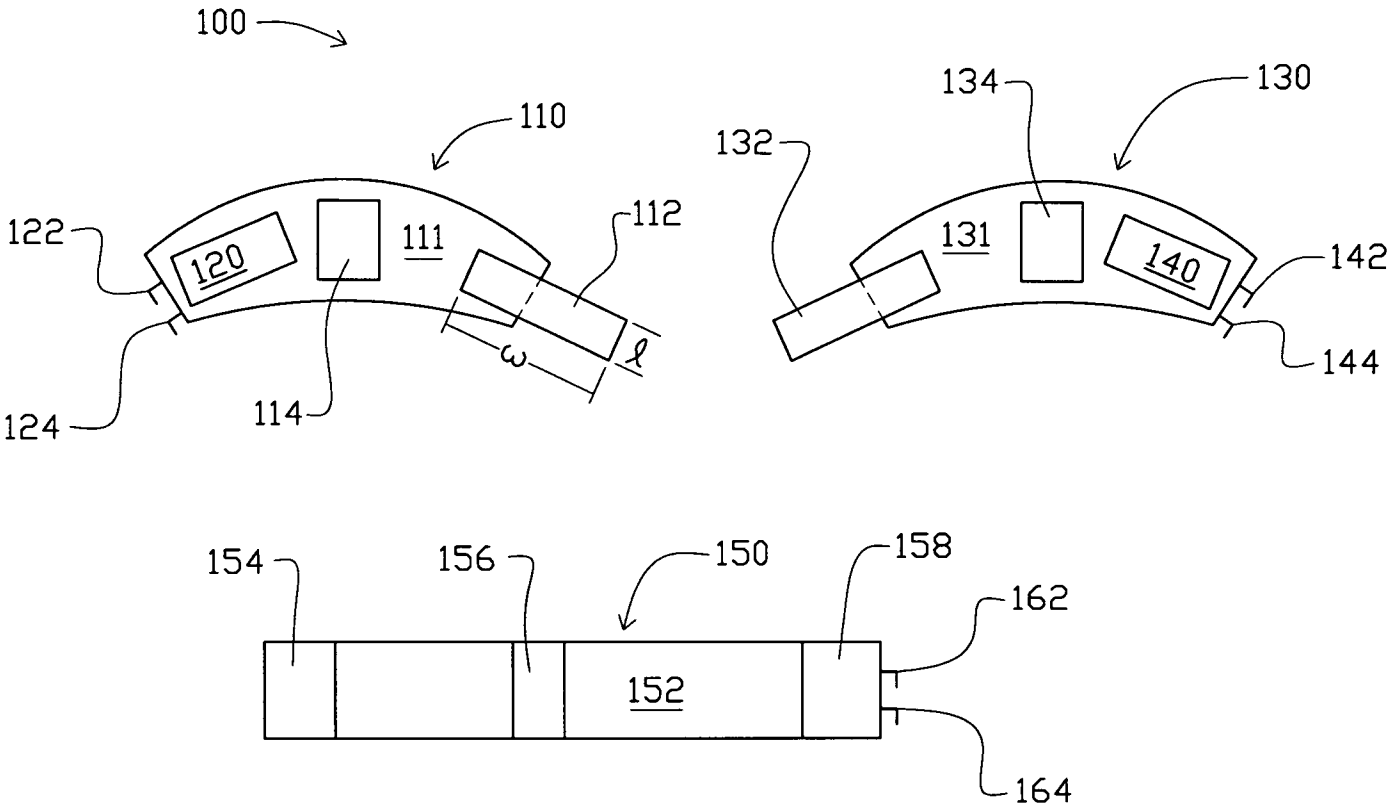
FIG. 1 illustrates a first side of inventive wraps 100.
Figure 2:
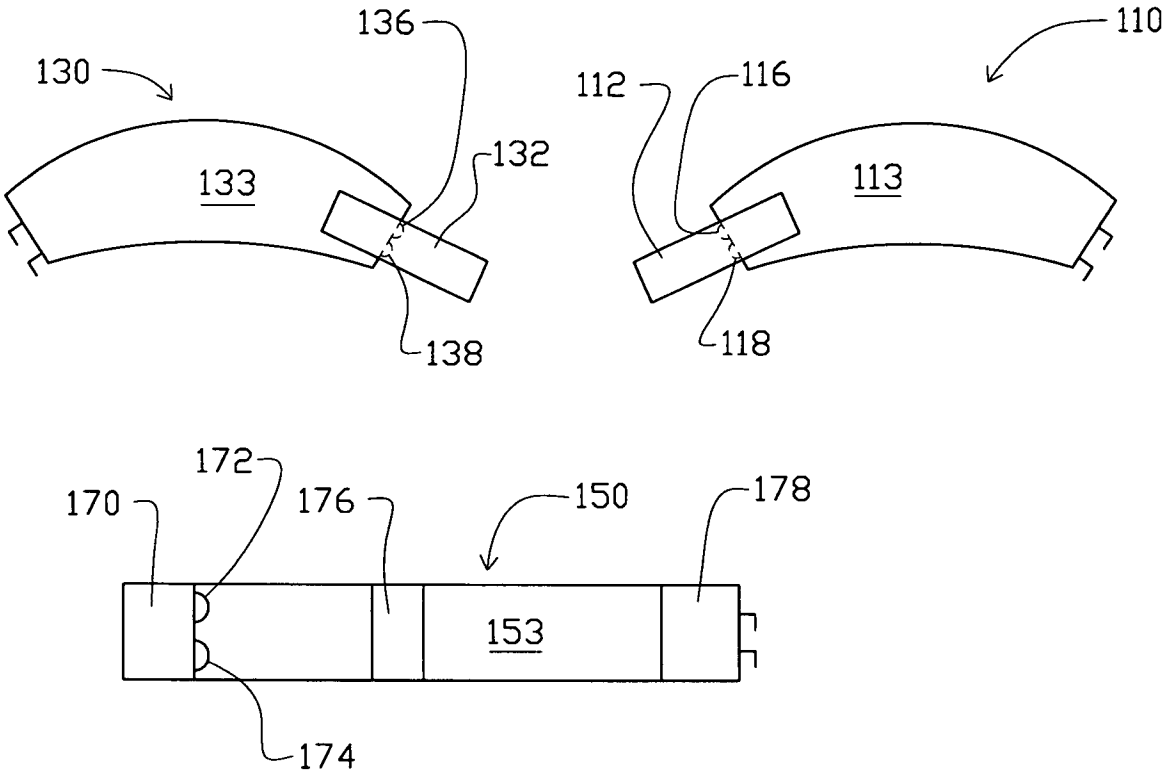
FIG. 2 illustrates a second side of inventive wraps 100. Simultaneous reference is made to FIG. 1 and FIG. 2. As is illustrated, there are generally two types of wraps 100: (a) thigh wraps 110, 130, and (b) resistance wrap(s) 150. The first thigh wrap 110 is illustrated showing an outward facing 111 portion, meaning the side of the first thigh wrap 110 which faces away from a user's leg when worn. The second thigh wrap 130 is illustrated by also showing an outward facing portion 131.

The first thigh wrap 110 has a first coupling 112 which is attached to and extends beyond the first thigh wrap 110, and enables the first thigh wrap 110 to attach to a user's thigh by "sticking" to a second coupling 120. The couplings 112, 120 together create a "hook and loop" (Velcro™) type-connection, which is in one embodiment at least three inches in width ("w") and one inch in length ("l"), and preferably at least four inches in width, and preferably one and one-half inch in length. However, additional advantages are achieved with alternative lengths and widths, such as a width of seven inches, to allow for size adjustments to accommodate various leg thicknesses. Although the length and width of the coupling 112 and 120 are illustrated as being of a substantially similar length and width, their lengths and widths may vary and deviate from each-other as needed to accomplish the needs of a particular product line.

Likewise, the second thigh wrap 130 has a first coupling 132 which is attached to and extends beyond the second thigh wrap 130, and enables the second thigh wrap 130 to attach to a user's thigh by "sticking" to a second coupling 140. The couplings 132, 140 have the length and width considerations as the couplings 112, 120. The thigh wrap couplings 112, 132 preferably have a hook-and-loops couplings facing both inwardly and outward, which perform the same function as the resistance wrap connection portions 114, 134 (this enables a user to open/close the thigh wraps 110, 130 on the inside of their thigh or the outside of their thigh). Preferably, the couplings 112, 132, 114 and 134 are loop-portions of the hook and loop type couplings.

Of course, other equivalent and/or supplemental connections exist, such as straps, belts, hooks, snaps, ties, magnets, and other connection means known to those of skill in the art. Additionally, the thigh wraps 110, 130 may also have pants-type belt-type loops (not shown, but known to those of skill in the apparel arts), directing at least one resistance wrap 150 around the thigh wraps 110, 130.

Connection reinforcements are contemplated, but optional. For example, hooks 122, 124, 142, 144, are securable into loops 116, 118, 136, 138 to "lock-in" the wraps 110, 130 to a user's thigh. Of course, other connection reinforcements are contemplated, such as belts, ties, or straps, for example. The first thigh wrap 110 and second thigh wrap 130 include the optional resistance wrap connection portions 114, 134 (respectively) that are couplable to the resistance wrap 150 via the resistance wrap outer-thigh connections 154, 156 or the couplings 112, 114.

The resistance wrap 150 has a thigh-facing portion 152 which includes a first thigh-facing attachment area 158 that couples to a first away-side attachment area 170. The attachment areas 158, 170 are preferably hook and loop coupled, with the first thigh-facing attachment area 158 being a hook-type attachment. Additionally, a second thigh-facing attachment area 156 and third thigh-facing attachment area 158, also on the thigh-facing portion 152, are also hook-type attachments. Similarly to the thigh wraps 110, 130, the resistance wrap 150 may have connection reinforcements such as loops 172, 174, and hooks 162, 164, or belts, ties, or straps, for example.

Each resistance wrap 150, on the side facing away from the thighs (the "away-side") 153, has a second away-side attachment area 176 and third away-side attachment area 178. The away-side attachment areas 170, 176, 178 are preferably loop-type attachments. The preferred configuration of hook-attachments and loop-attachments (and its equivalent reverse) enable the invention to have wraps that are able to stack on top of each other. This leads to the following discussion of the "stacking" of multiple wraps, perhaps of the same or different resistances, one-over-the-other. When stacking one wrap over another, it is preferred to wrap each resistance wrap in alternating directions around the thighs, and to alternate the thigh that is used as the point of initial contact. For example, if a first resistance wrap's first thigh-facing attachment is attached to the right thigh, and the resistance wrap is coupled about the thighs as directed, then a second resistant wrap's first thigh-facing attachment should be attached to the left thigh and then coupled about the thighs.

A variety of materials may generate a desired resistance, however, it is preferred that a plurality (here four) bands are provided of varying resistances. It is also preferred that the wraps have a resistance indication on them, which may include a color code. For example, a level 1 wrap may be yellow and provide up to five pounds of resistance when worn, a level 2 wrap may be green and provide up to ten pounds of resistance when worn, a level 3 wrap may be red and provide up to fifteen pounds of resistance when worn, and a level 4 wrap may be blue and provide up to 20 pounds of resistance when worn.

Table 1 discloses particulars, such as preferred material combinations, used to make various wrap embodiments. The percentages and ratios are exemplary, and approximate.

TABLE 1

| Resistance Wrap | Level 1 | Level 2 | Level 3 | Level 4 |
|---|---|---|---|---|
| elastomer: | 37#guage | 37#guage | 37#guage | 37#guage |
| Warps & filler: | Polyester | Polyester | Polyester | Polyester |
| Elongation: | 1:20-1:30 | 1:20-1:30 | 1:20-1:30 | 1:20-1:30 |
| Yield: | 10 yds/lb | 8 yds/lb | 6.5 yds/lb | 5 yds/lb |
| Materials % | 70% polyester, 30% rubber | 55% polyester, 45% rubber | 48% polyester, 52% rubber | 45% polyester, 55% rubber |

Figure 3:
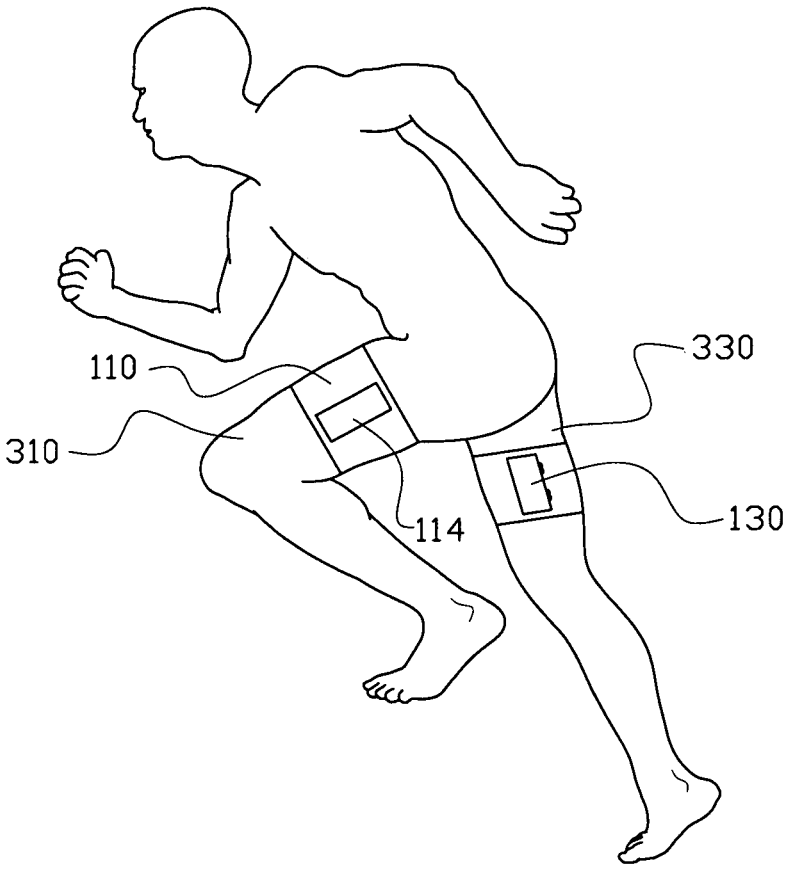

FIG. 3 shows the inventive thigh wraps being worn by a user. Here, one can see advantages of arched-shaped thigh wraps—they more readily conform to the shapes of a thigh. However, it should be understood that one may design thigh wraps of other shapes without departing from the claimed invention. Accordingly, the first thigh wrap 110 is secured to a left thigh 310 of a user, and the second thigh wrap 130 is secured to a right thigh 330 of a user. Now the user is ready to attach the resistance wrap(s) 150 to the thigh wraps 110, 130.

Figure 4:
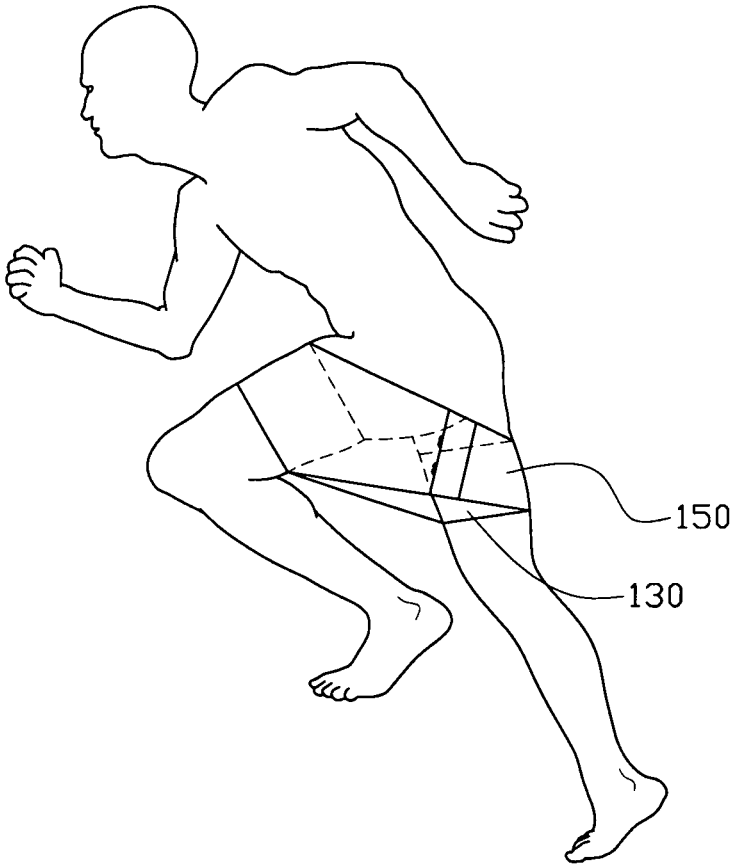

FIG. 4 shows the inventive resistance wrap 150 secured to thigh wraps 110, 130 with an inner-thigh coupling position (meaning, that the thigh wraps close their connections on the interior portion of each thigh). Although not viewable in FIG. 3, the resistance wrap's first thigh connection 154 is coupled to the first resistance wrap connection portion 114, and similarly the second thigh connection 156 is coupled to the second resistance wrap connection portion 134, whereupon the third thigh connection 158 is coupled to the out-ward facing first thigh connection 170. Accordingly configured, a user will experience force resistance along the muscles in each thigh (including the hamstrings), in each of the dimensions of movement.

Though the invention has been described with respect to specific preferred embodiments, many variations and modifications will become apparent to those skilled in the art upon reading the present application. Specifically, the invention may be altered in ways readily apparent to those of ordinary skill in the art upon reading the present disclosure. It is therefore the intention that the appended claims and their equivalents be interpreted as broadly as possible in view of the prior art to include all such variations and modifications.

I claim:

1. An apparatus for facilitating exercising, comprising:

a first thigh wrap, the first thigh wrap having an outward facing portion adapted to face away from a user's legs when worn, having a first coupling adapted to enable the first thigh wrap to attach to a user's thigh by attaching to a second coupling, a second thigh wrap, the second thigh wrap having an outward facing portion adapted to face away from a user's legs when worn, having a first coupling adapted to enable the second thigh wrap to attach to a user's thigh by attaching to a second coupling, a first elastic resistance wrap coupled about the first thigh wrap and the second thigh wrap, the first elastic resistance wrap being substantially elongated and having a thigh-facing portion and an away-side, the thigh-facing portion having a first thigh-facing attachment area able to be coupled to either of the first coupling of the first thigh wrap or the first coupling of the second thigh wrap, and at least a second thigh-facing portion that couples to a first away-side attachment area of the away side, the first away-side attachment area being substantially opposite the first thigh-facing attachment area, and a second elastic resistance wrap, coupled about the first elastic resistance wrap, the second elastic resistance wrap being substantially elongated and having a thigh-facing portion and an away-side, the thigh-facing portion of the second elastic resistance wrap having a first thigh-facing attachment area able to be coupled to either of the first away-side attachment area or a second away-side attachment area of the first elastic resistance wrap, and the second elastic resistance wrap has at least a second thigh-facing portion that couples to a first away-side attachment area of the second elastic resistance wrap, the first away-side attachment area being substantially opposite the first thigh-facing attachment area.

2. The apparatus of claim 1 wherein the first thigh wrap and the second thigh wrap are substantially arc-shaped.

3. The apparatus of claim 1 wherein the first thigh wrap further comprises a supplemental connection.

4. The apparatus of claim 1 wherein the second thigh wrap further comprises a supplemental connection.

5. The apparatus of claim 1 wherein each of the first thigh wrap and the second thigh wrap further comprise a connection reinforcement.

6. The apparatus of claim 5 wherein each connection reinforcement comprises a tie-type connection.

7. The apparatus of claim 1 wherein the first elastic resistance wrap further comprises a connection reinforcement.

8. The apparatus of claim 1 wherein the first elastic resistance wrap comprises polyester and rubber.

9. The apparatus of claim 1 wherein the first elastic resistance wrap comprises approximately 70% polyester and approximately 30% rubber.

10. The apparatus of claim 1 wherein the first elastic resistance wrap comprises polyester and rubber, and the second elastic resistance wrap comprises polyester and rubber.

* * * * *